US006872144B2

(12) United States Patent
Kroon et al.

(10) Patent No.: US 6,872,144 B2
(45) Date of Patent: Mar. 29, 2005

(54) AMUSEMENT DEVICE

(75) Inventors: Louisito Johannes Eusebio Kroon, Neede (NL); Albert Louisito Phillipus Kroon, Neede (NL)

(73) Assignee: Cobra Beheer B.V. (NL)

( * ) Notice: Subject to any disclaimer, the term of this patent is extended or adjusted under 35 U.S.C. 154(b) by 0 days.

(21) Appl. No.: 10/682,688

(22) Filed: Oct. 9, 2003

(65) Prior Publication Data

US 2004/0198523 A1 Oct. 7, 2004

(30) Foreign Application Priority Data

Oct. 9, 2002 (NL) ..... 1021610

(51) Int. Cl.[7] ..... A63G 27/00
(52) U.S. Cl. ..... 472/45; 472/47
(58) Field of Search ..... 472/3, 27, 44, 472/45, 46, 47; 280/411.1, 412, 413

(56) References Cited

U.S. PATENT DOCUMENTS 1,935,558 A * 11/1933 Haskell ..... 472/22
2,203,971 A * 6/1940 Shepherd ..... 472/44
2,423,283 A * 7/1947 Austin ..... 472/16
2,432,709 A * 12/1947 Austin ..... 472/44
2,847,216 A 8/1958 Courtney
3,456,943 A * 7/1969 Brown ..... 472/3
4,643,416 A * 2/1987 van der Veen ..... 472/45
5,964,665 A * 10/1999 Uemura ..... 472/45
6,634,952 B2 * 10/2003 Kroon et al. ..... 472/3

FOREIGN PATENT DOCUMENTS

DE 94 10 114 U 9/1994
DE 94 15 858 U 1/1995
GB 1 212 779 A 11/1970

* cited by examiner

*Primary Examiner*—K. T. Nguyen
(74) *Attorney, Agent, or Firm*—Webb Ziesenheim Logsdon Orkin & Hanson, P.C.

(57) ABSTRACT

An amusement device, including a frame made from four support legs which, running obliquely upwards toward one another, at their top end support a rotary member, an arm, one end of which is secured to the rotary member and which can be pivoted between the support legs, and a receiving device for people, which is suspended from the other end of the arm. The support legs, at their bottom end, are secured to a trailer by means of hinges, the hinge axis of which is oriented transversely with respect to the longitudinal direction of the trailer, and the axis of rotation of the rotary member is oriented in the longitudinal direction of the trailer.

20 Claims, 6 Drawing Sheets

AMUSEMENT DEVICE

BACKGROUND OF THE INVENTION

1. Field of the Invention

The invention relates to an amusement device, including a frame made from four support legs which, running obliquely upwards toward one another, at their top end support a rotary member, an arm, one end of which is secured to the rotary member and which can be pivoted between the support legs, and a receiving device for people, which is suspended from the other end of the arm.

2. Description of Related Art

An amusement device of this type is known. Its four support legs are jointed. In the assembled state, these support legs each rest directly on the ground in order to provide the device with the required stability. A reasonable degree of stability is highly important in view of the relatively high imbalance which is generated when the amusement device is operating as a result of the swinging arm with a fully occupied receiving device attached to it.

The support legs and various other components of the known amusement device can be transported on a trailer in the transportation position. Before the amusement device can be used, it has to be assembled, during which operation, as described above, the support legs have to be supported separately, remote from the trailer. A construction method of this type is relatively laborious. In particular the operation of erecting the support legs is laborious. It must be borne in mind that to do this, a good erection spot outside the trailer has to be selected, since otherwise it is impossible to guarantee the stability of the amusement device.

SUMMARY OF THE INVENTION

Therefore, it is an object of the invention to provide an amusement device of the type described above which avoids these drawbacks and can be erected stably in a relatively simple way. This object is achieved by virtue of the fact that the support legs, at their bottom end, are secured to a trailer by means of hinges, the hinge axis of which is oriented transversely with respect to the longitudinal direction of the trailer, and that the axis of rotation of the rotary member is oriented in the longitudinal direction of the trailer.

In the amusement device according to the invention, the support legs remain permanently attached to the trailer. This makes it possible for the support legs to be set up within a relatively short time and also to be folded down again within a relatively short time. The trailer, which itself must of course be set up on a stable area of ground, is responsible for providing excellent support to the support legs which have been erected.

Since the width of the trailer, in view of the requirements of road traffic, has to remain within certain limits, the distance between two legs located at an end of the trailer is limited. Therefore, it is not readily possible for the arm with the receiving device to be moved between these pairs of legs. For this reason, the center axis of the rotary member from which the arm with receiving device is suspended is oriented in the longitudinal direction of the trailer, in such a manner that the movement now takes place between the pairs of support legs and transversely with respect to the trailer.

To increase the stability, it is possible for stabilizing arms to be located at both longitudinal ends of the trailer, which arms can be displaced between an active position, which is transverse with respect to the longitudinal direction of the trailer, and a folded-down position running along the trailer.

It is preferable for a trestle to be located at both longitudinal ends of the trailer, in such a manner that in each case two support legs are secured in hinged fashion to each trestle. In that case, the stabilizing arms can each be connected to the trailer and a trestle in such a manner that they can rotate about a vertical axis of rotation. When the amusement device is being set up, these stabilizing arms can easily be unfolded. However, they remain attached to the trailer, which further increases the speed and simplicity of erecting and dismantling the amusement device.

Furthermore, the floor of the trailer may have a downwardly recessed floor section at the location of the path of the receiving device. In this case, it is possible for a platform to be secured to the recessed floor section. This platform can be moved up and down to allow the occupants to take their seats. In the downwardly moving position, the arm with receiving device has a clear path.

The arm, at its end remote from the rotary member, has a rotary ring, from which at least two auxiliary arms slope obliquely away from one another, and each of the auxiliary arms bears at least one seat for a person. The arm can preferably be kept relatively short. An advantage of this is that the relatively heavy rotary ring with drive does not have an excessively great moment arm with respect to the rotary member. Consequently, the capacity of the drive can be kept to a limited level.

Preferably, the support legs are connected to one another in pairs at their top end, in such a manner that support legs of one pair are pivotably secured at one end of the trailer and the support legs of the other pair are pivotably secured at the other end of the trailer. In this case, the dimension of the support legs transversely to the hinge axis is smaller than the distance between these hinge axes at the two ends of the trailer, so that the support legs can be folded down flat onto the trailer.

BRIEF DESCRIPTION OF THE DRAWINGS

The amusement device according to the invention will now be explained in more detail on the basis of the exemplary embodiment illustrated in the figures, in which.

DESCRIPTION OF THE PREFERRED EMBODIMENT

Figure 1:
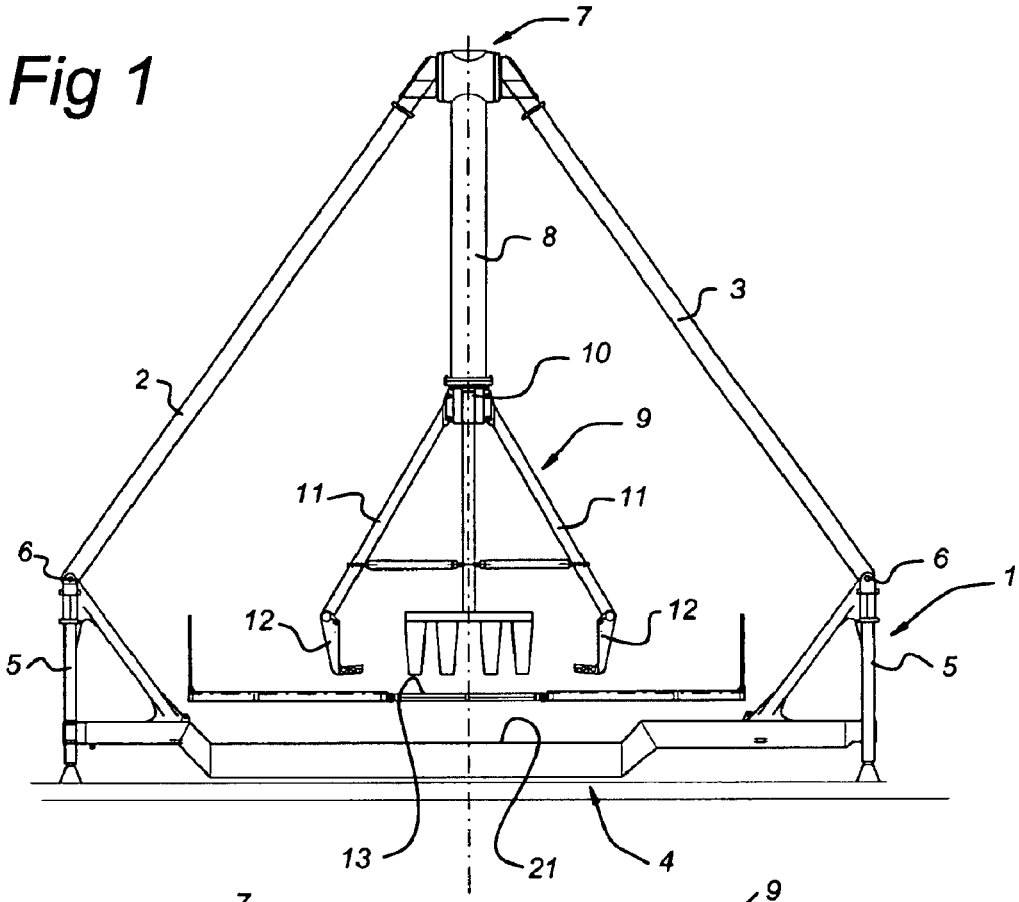
FIG. 1 shows a side view of the amusement device.

The amusement device according to the invention illustrated in FIG. 1 comprises a frame 1 which has a first pair of support arms 2, a second pair of support arms 3, a trailer 4 and two trestles 5 at the longitudinal ends of the trailer 4. The pairs of support arms 2, 3 are each secured to the trestles 5 by means of hinges 6, the hinge axis of which is oriented transversely with respect to the longitudinal direction of the trailer 4. At their top end, the pairs of support legs 2, 3 support a rotary member 7, the axis of which is oriented in the longitudinal direction of the trailer 4. An arm 8, which bears a receiving device 9 by means of the rotary ring 10, is secured to the rotary member 7. The receiving device 9 has four arms 11, two of which, each bearing a row of seats 12, can be seen in FIGS. 1 and 2.

Furthermore, on the trailer 4 at the level of the recessed section 21 there is a platform 13, from where the occupants can gain access to the seats 12. Stabilizing arms 14, which can be displaced between the folded-down position along the trailer 4 shown in FIG. 1 and the folded-out position shown in FIG. 2, are secured to the longitudinal ends of the trailer 4 and the trestles 5.

Figure 2:
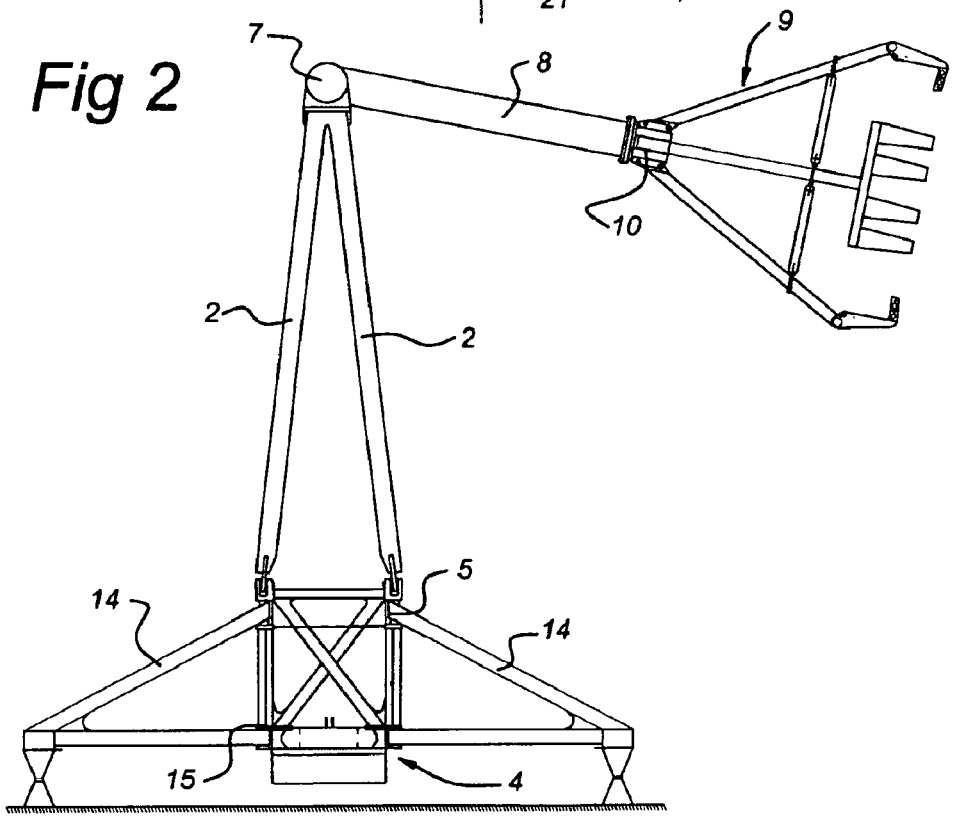
FIG. 2 shows a front view of the amusement device, with the arm swung up.
Figure 3:
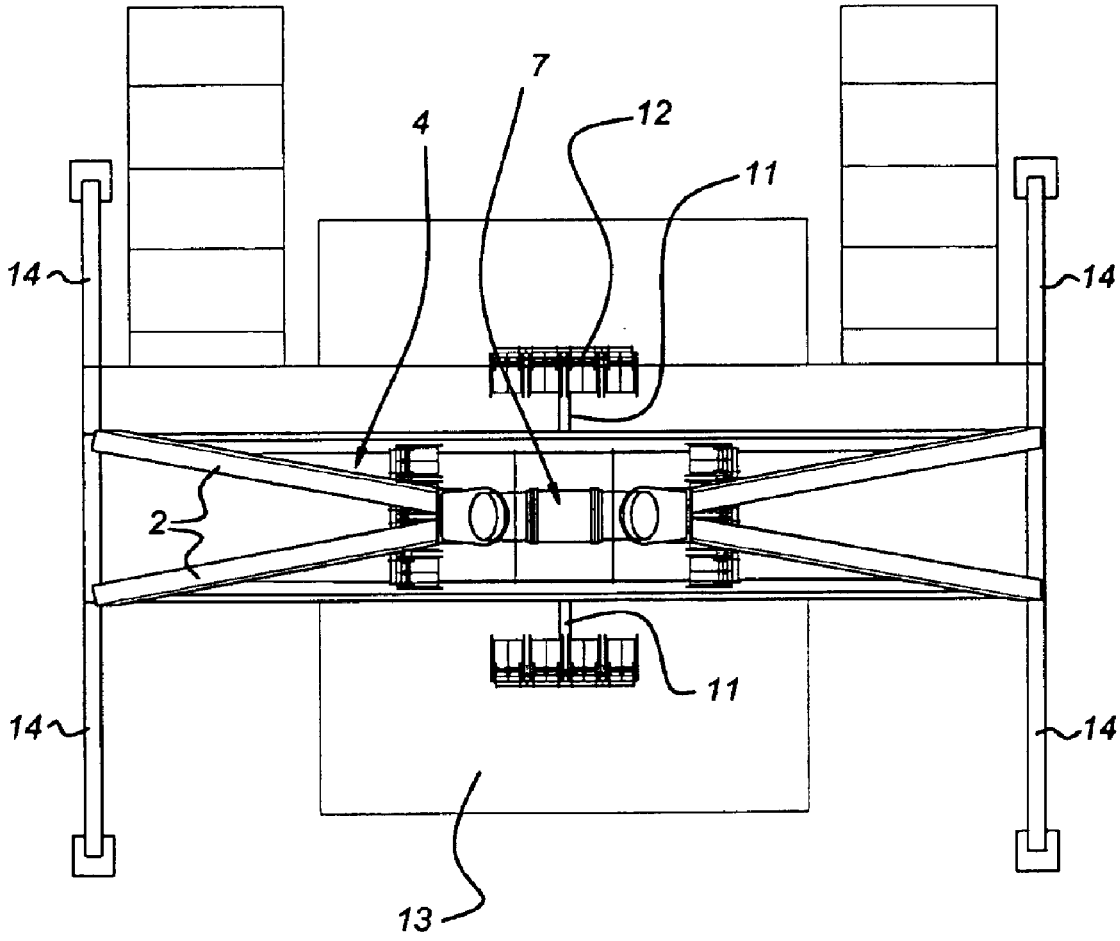
FIG. 3 shows a plan view of the amusement device.

As can be seen clearly from FIGS. 1 and 2, the arm 8 with the receiving device 9 can be pivoted between on the one hand the pair of legs 2 and on the other hand the pair of legs 3. In the process, the stabilizing arms 14 ensure the required stability of the trailer 4.

Electro-hydraulic drives for generating the desired rotary movements are provided at the location of the rotary member 7 of the rotary ring 10.

Figure 4:
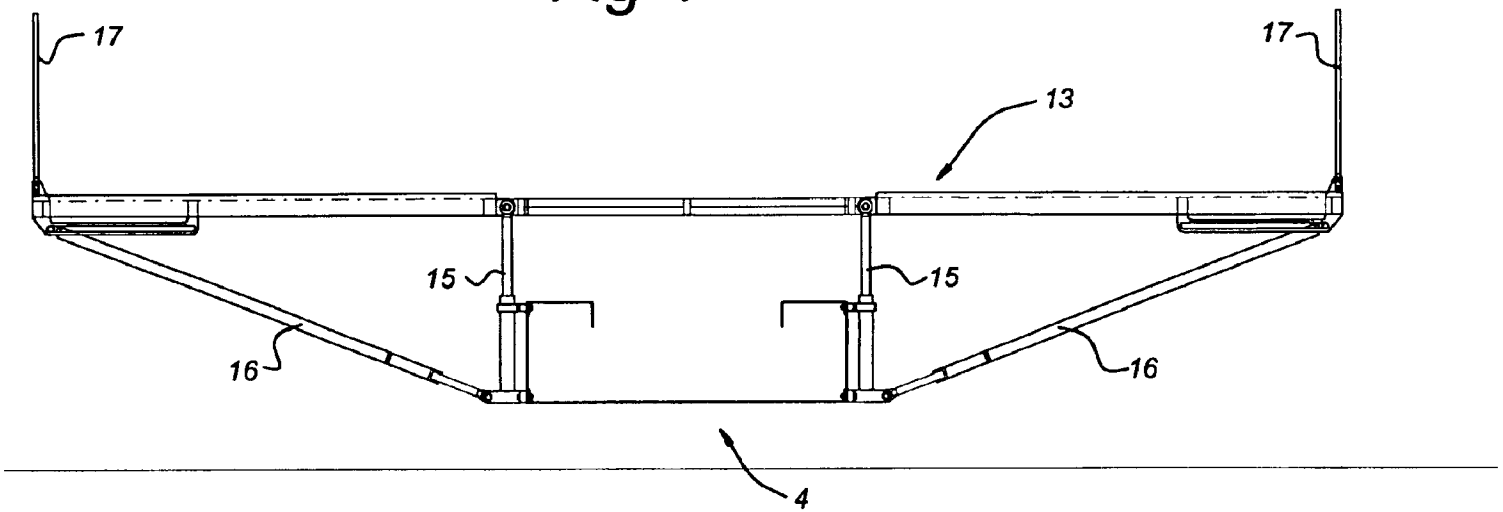
FIGS. 4 and 5 show a detail relating to the platform.
Figure 5:
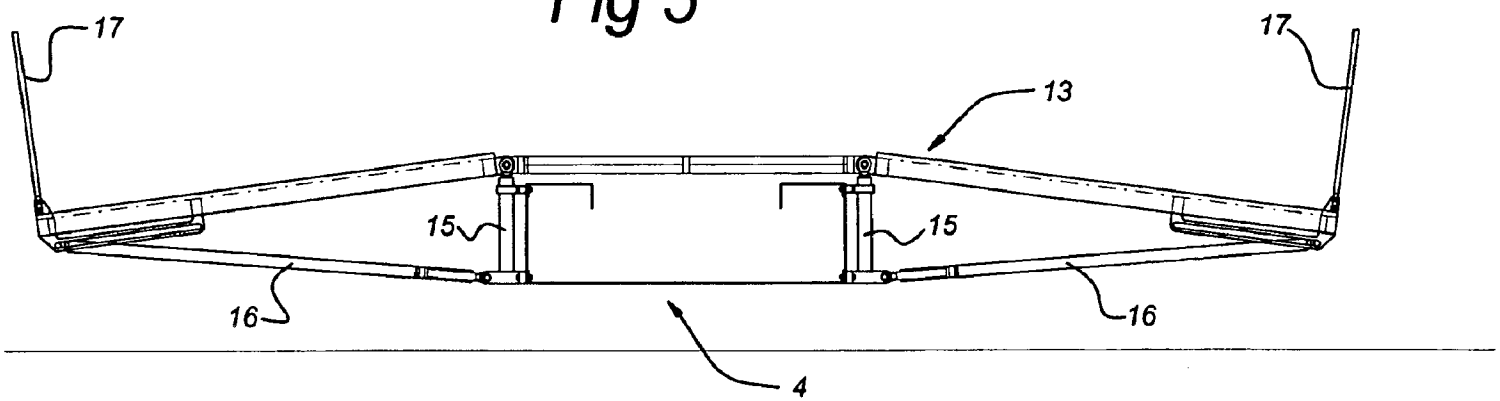
Figure 6:
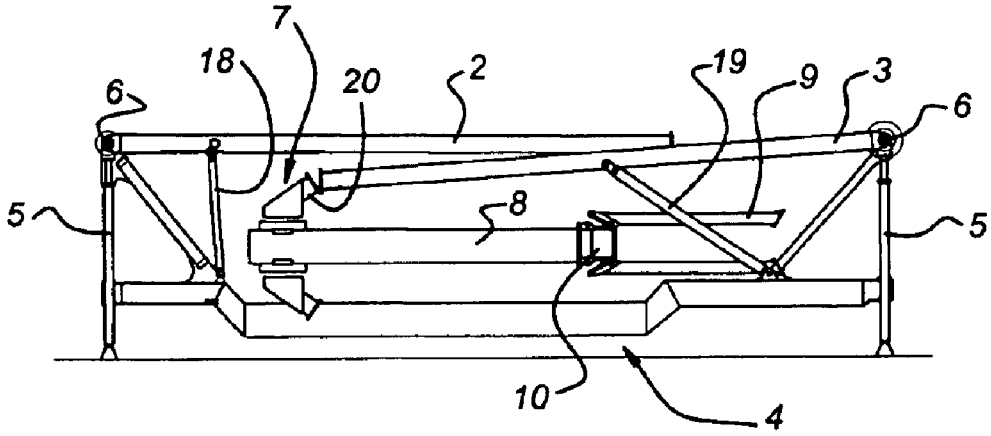
FIGS. 6–11 show the various phases involved in constructing the amusement device.

FIGS. 4 and 5 show the platform 13 in two different positions. The state shown in FIG. 4 illustrates the platform 13 in the position in which the occupants can gain access to the seats 12. For this purpose, the jacks 15, 16 have been moved into their extended position.

FIG. 5 shows the state of the platform 13 in its lowered position. The jacks 15 and 16 have in this case been retracted. In this position, the arm 8 with the receiving device 9 and the seats 12 can move freely over the platform without coming into contact with it and in particular with its gates and fences 17.

A description of how the amusement device according to the invention can be erected will now be given with reference to FIGS. 6–11. In the transportation position illustrated in FIG. 6, the support legs 2, 3 have been moved downward about their respective hinge pins 6 on the trestles 5. The pair of support legs 2 is connected to a jack 18, and the pair of support legs 3 is connected to a jack 19. At the top end, the pair of support legs 3 is secured to the rotary member 7 by means of a hinge 20. The arm 8, the rotary ring 10 and the auxiliary arms 9 are located on this rotary member 7.

Figure 7:
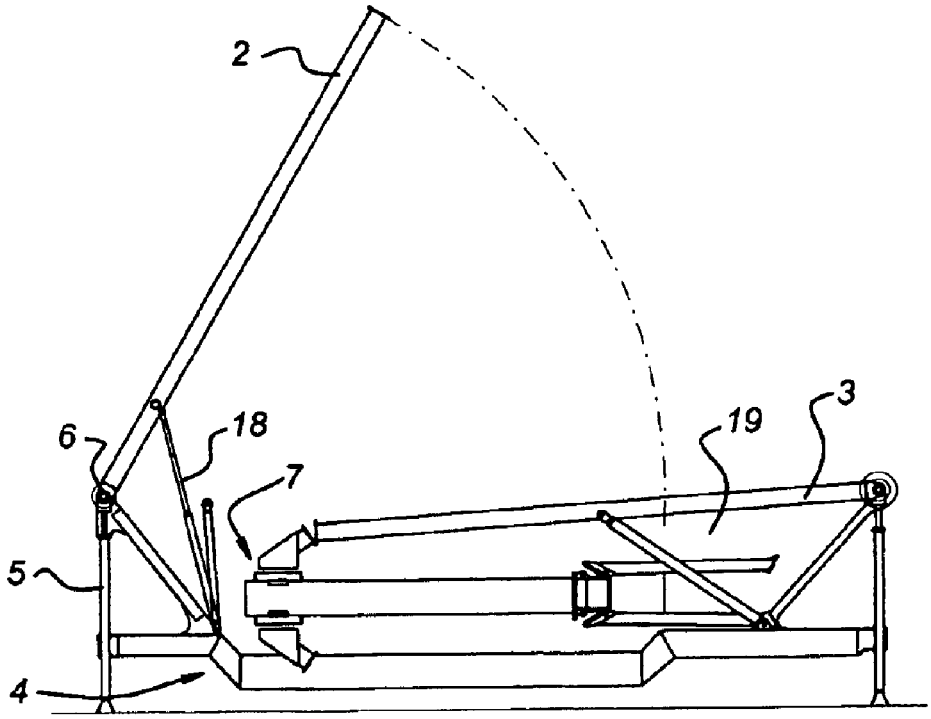
Figure 8:
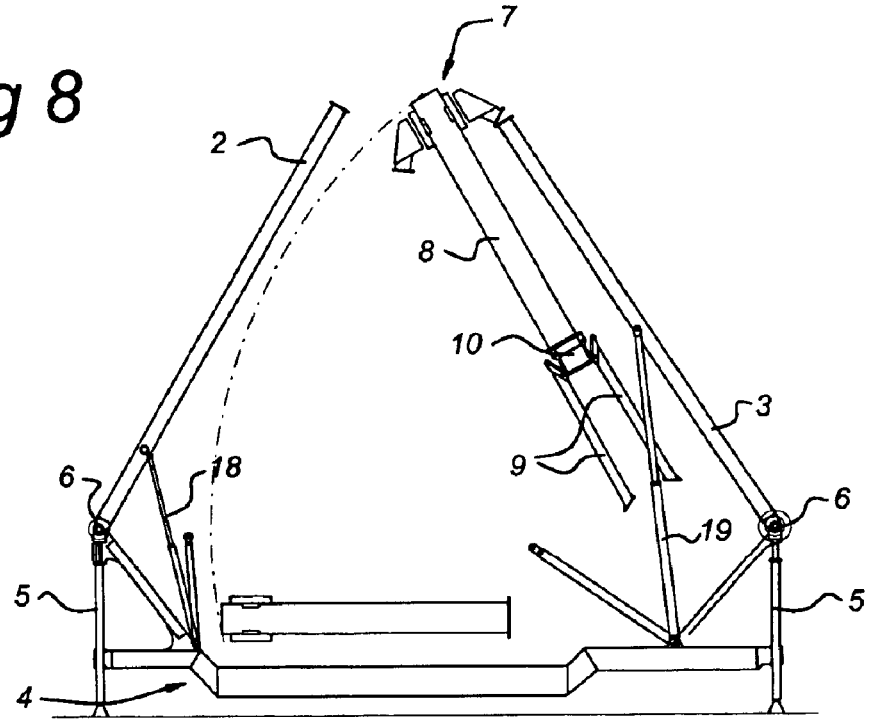
Figure 9:
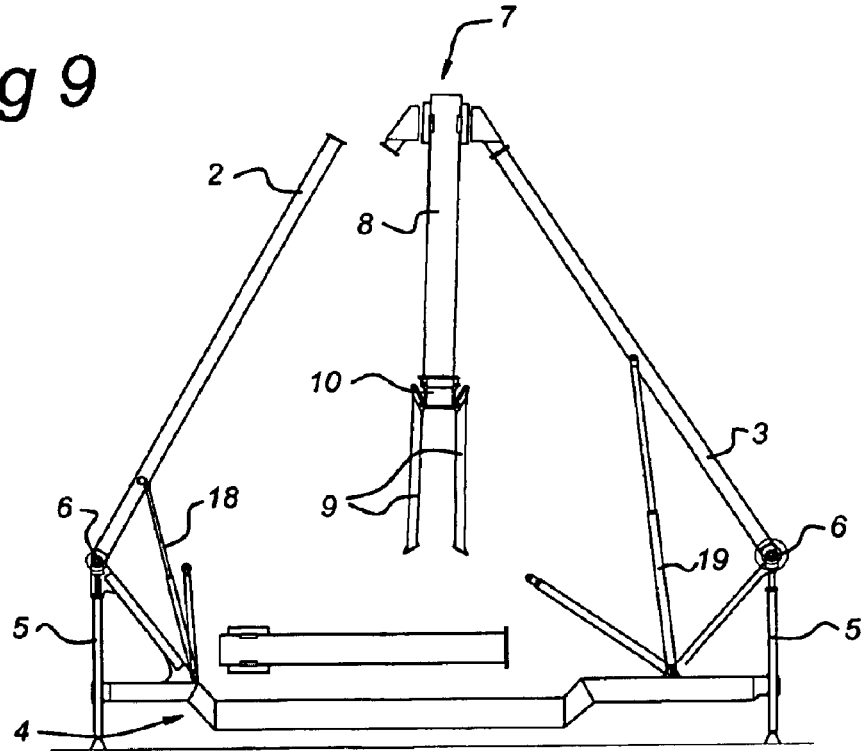
Figure 10:
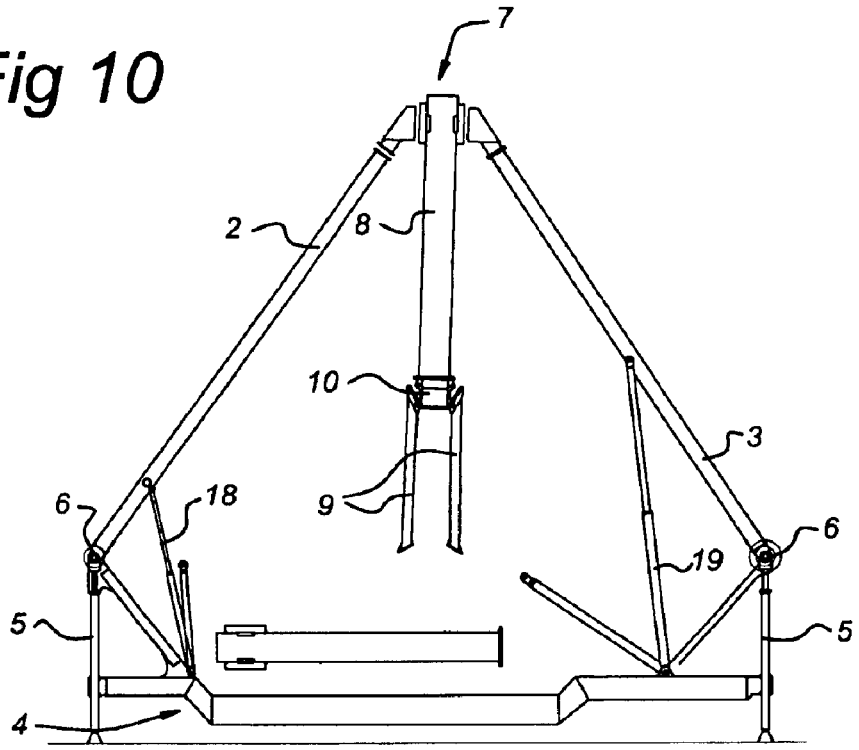
Figure 11:
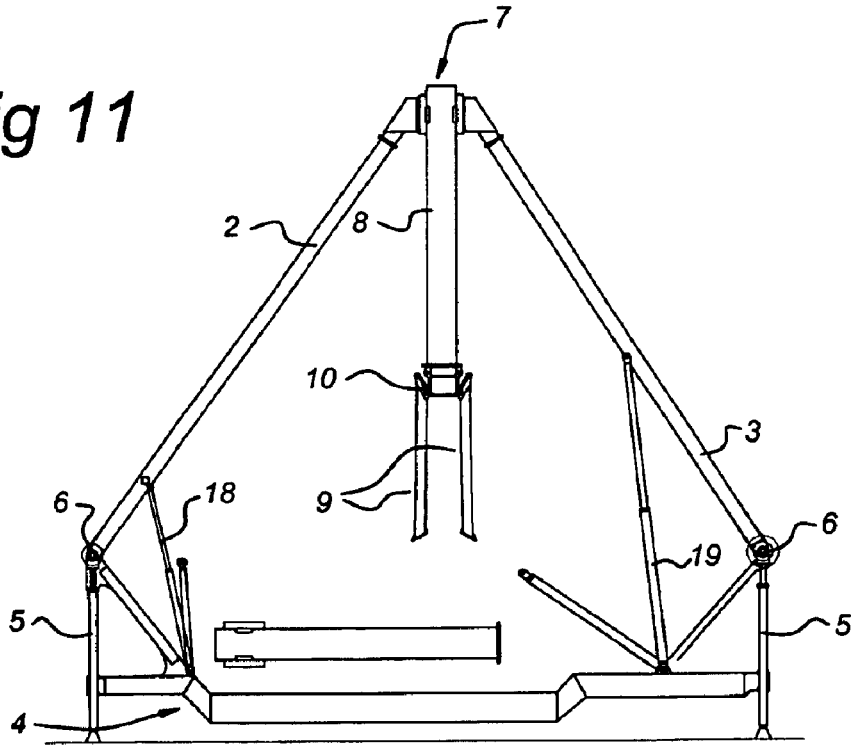

As shown in FIG. 7, when the device is being erected, first of all the pair of support legs 2 is pivoted upward by means of the jack 18. FIG. 8 shows that then the pair of support legs is pivoted upward by means of the jack 19, with the arm 8, the rotary ring 10 and the auxiliary arms 9 also being moved upward with them. After the pair of support arms 3 have been moved into the correct position as shown in FIG. 9, and the arm 8 with the rotary member 7 has been pivoted, it is possible, as shown in FIGS. 10 and 11, for the rotary member 7 to be attached to the pair of support legs 2, for example by means of a bolted connection.

Finally, the seat devices 12 can be attached to the auxiliary arms 19 and the platform (not shown) can be put in place. Of course, it is also possible for the stabilizing arms 14 (not shown in FIGS. 6–11) then to be folded out into the state shown in FIG. 2.

What is claimed is:

1. An amusement device, comprising:

a frame made from four support legs, wherein the support legs run obliquely upwards toward one another, further wherein each of the support legs has a top end and a bottom end, and the top end of each support leg supports a rotary member;

an arm, wherein one end of the arm is secured to the rotary member and is configured to pivot between the support legs; and a receiving device for people, wherein the receiving device is suspended from the other end of the arm, wherein the support legs at their bottom end are secured to a trailer by hinges, further wherein a hinge axis of each of the hinges is oriented transversely with respect to the longitudinal direction of the trailer, and the axis of rotation of the rotary member is oriented in the longitudinal direction of the trailer.

2. The amusement device as claimed in claim 1, further comprising stabilizing arms located at both longitudinal ends of the trailer, wherein the stabilizing arms can be displaced between an active position which is transverse with respect to the longitudinal direction of the trailer and a folded-in position along the trailer.

3. The amusement device as claimed in claim 2, wherein a trestle is located at both longitudinal ends of the trailer and two support legs are secured in a hinged manner to each of said trestles.

4. The amusement device as claimed in claim 2, wherein the stabilizing arms are each connected to the trailer and a trestle in such a manner that the stabilizing arms can rotate about a vertical axis of rotation.

5. The amusement device as claimed in claim 2, wherein the trailer has a floor, wherein the floor has a downwardly recessed floor section at the location of a path of the receiving device.

6. The amusement device as claimed in claim 2, wherein the arm, at its end remote from the rotary member, has a rotary ring, from which at least two auxiliary arms slope obliquely away from one another, and each of the auxiliary arms bears at least one seat for a person.

7. The amusement device as claimed in claim 2, wherein the support legs are connected to one another in pairs at their top end so that the support legs of one pair are pivotably secured at one end of the trailer and the support legs of the other pair are pivotably secured at the other end of the trailer.

8. The amusement device as claimed in claim 2, wherein the dimension of the support legs transversely to the hinge axis is less than the distance between hinge axes at both ends of the trailer.

9. The amusement device as claimed in claim 1, wherein a trestle is located at both longitudinal ends of the trailer and two support legs are secured in a hinged manner to each of said trestles.

10. The amusement device as claimed in claim 9, wherein the stabilizing arms are each connected to the trailer and the trestle in such a manner that the stabilizing arms can rotate about a vertical axis of rotation.

11. The amusement device as claimed in claim 1, wherein the trailer has a floor, wherein the floor has a downwardly recessed floor section at the location of a path of the receiving device.

12. The amusement device as claimed in claim 11, wherein a platform is secured to the recessed floor section.

13. The amusement device as claimed in claim 12, wherein the platform can be moved up and down.

14. The amusement device as claimed in claim 1, wherein the arm, at its end remote from the rotary member, has a rotary ring, from which at least two auxiliary arms slope obliquely away from one another, and each of the auxiliary arms bears at least one seat for a person.

15. The amusement device as claimed in claim 1, wherein the support legs are connected to one another in pairs at their top end so that the support legs of one pair are pivotably secured at one end of the trailer and the support legs of the other pair are pivotably secured at the other end of the trailer.

16. The amusement device as claimed in claim 15, wherein the support legs of one of the pairs are releasably secured to the rotary member.

17. The amusement device as claimed in claim 16, wherein the support legs of one of the pairs are hinged to the rotary member.

18. The amusement device as claimed in claim 16, wherein the dimension of the support legs transversely to the hinge axis is less than the distance between hinge axes at both ends of the trailer.

19. The amusement device as claimed in claim 15, wherein the support legs of one of the pairs are hinged to the rotary member.

20. The amusement device as claimed in claim 1, wherein the dimension of the support legs transversely to the hinge axis is less than the distance between hinge axes at both ends of the trailer.

* * * * *